US007988496B2

(12) United States Patent
Zhu

(10) Patent No.: US 7,988,496 B2
(45) Date of Patent: Aug. 2, 2011

(54) ELECTRICAL CONNECTOR WITH IMPROVED ELASTICITY CONTACTS

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/780,958

(22) Filed: May 17, 2010

(65) Prior Publication Data

US 2011/0059655 A1 Mar. 10, 2011

(30) Foreign Application Priority Data

Sep. 4, 2009 (CN) ..... 2009 2 0309658.5

(51) Int. Cl.
*H01R 24/00* (2006.01)
*H01R 33/00* (2006.01)

(52) U.S. Cl. ..... 439/660; 439/329

(58) Field of Classification Search ..... 439/660, 439/329, 571, 78, 79, 59
See application file for complete search history.

(56) References Cited

U.S. PATENT DOCUMENTS

| | | | | |
|---|---|---|---|---|
| 4,118,096 | A * | 10/1978 | Takahashi | 439/400 |
| 7,632,111 | B2 * | 12/2009 | Xiong et al. | 439/79 |
| 7,766,664 | B2 * | 8/2010 | Cheng et al. | 439/65 |
| 7,850,486 | B2 * | 12/2010 | Zhu | 439/570 |
| 7,857,638 | B2 * | 12/2010 | Zhu | 439/78 |
| 2009/0142953 | A1 * | 6/2009 | Patel et al. | 439/345 |
| 2009/0311887 | A1 * | 12/2009 | Zhu | 439/67 |
| 2010/0015836 | A1 * | 1/2010 | Zhu | 439/329 |
| 2010/0055977 | A1 * | 3/2010 | Zhu | 439/571 |
| 2010/0081338 | A1 * | 4/2010 | Cheng et al. | 439/668 |

* cited by examiner

*Primary Examiner* — Hae Moon Hyeon
(74) *Attorney, Agent, or Firm* — Wei Te Chung; Andrew C. Cheng; Ming Chieh Chang

(57) ABSTRACT

An electrical connector includes an insulative housing defining upper and lower rows of passageways arranged in a longitude direction and each of passageway extends along a front-to-back direction perpendicular to said front-to-back direction; upper and lower rows of contacts are assembled into the corresponding upper and lower rows of passageways, respectively; wherein each of said contact has a mating portion folded in half, the mating portion defines a pair of inner faces facing to each other and a pair of outer faces facing away from each other, at least one protruding portion protrudes from one of the inner faces to the other inner face.

20 Claims, 5 Drawing Sheets

ELECTRICAL CONNECTOR WITH IMPROVED ELASTICITY CONTACTS

BACKGROUND OF THE INVENTION

1. Field of the Invention

The present invention relates to an electrical connector, and particularly to an electrical connector adapted for mounting on a print circuit board.

2. Description of the Related Art

A kind of COMBO Serial ATA connectors are widely used in modern industry which includes a plurality of signal contacts and jumper contacts. The jumper contacts are arranged into upper and lower rows. Each jumper contact has a contact portion pressing against the printed circuit board elastically. The cross section of the contact portion is a square with a 0.64 mm×0.64 mm in dimension. This kind of structure could not offer a good elastic force and always leads to plastic deformation of the contact portion.

A kind of COMBO SATA connectors are widely used in modern industry which includes a plurality of signal contacts and jumper contacts. The jumper contacts are arranged into upper and lower rows. Each jumper contact has a contact portion pressing against the printed circuit board elastically. The cross section of the contact portion is a square with a 0.64 mm×0.64 mm in dimension. This kind of structure could not offer a good elastic force and always leads to plastic deformation of the contact portion.

Hence, a new type of contact is desired to overcome the disadvantages of the related art.

BRIEF SUMMARY OF THE INVENTION

Therefore, a main object of the present invention is to provide an electrical connector with a new type of contacts and manufacturing process.

To fulfill the above-mentioned object, an electrical connector, comprising an insulative housing defining upper and lower rows of passageways arranged in a longitude direction and each of passageway extending along a front-to-back direction perpendicular to said front-to-back direction; upper and lower rows of contacts assembled into the corresponding upper and lower rows of passageways, respectively; wherein each of said contact having a mating portion folded in half, the mating portion defines a pair of inner faces facing to each other and a pair of outer faces facing away from each other, at least one protruding portion protrudes from one of the inner faces to the other inner face.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
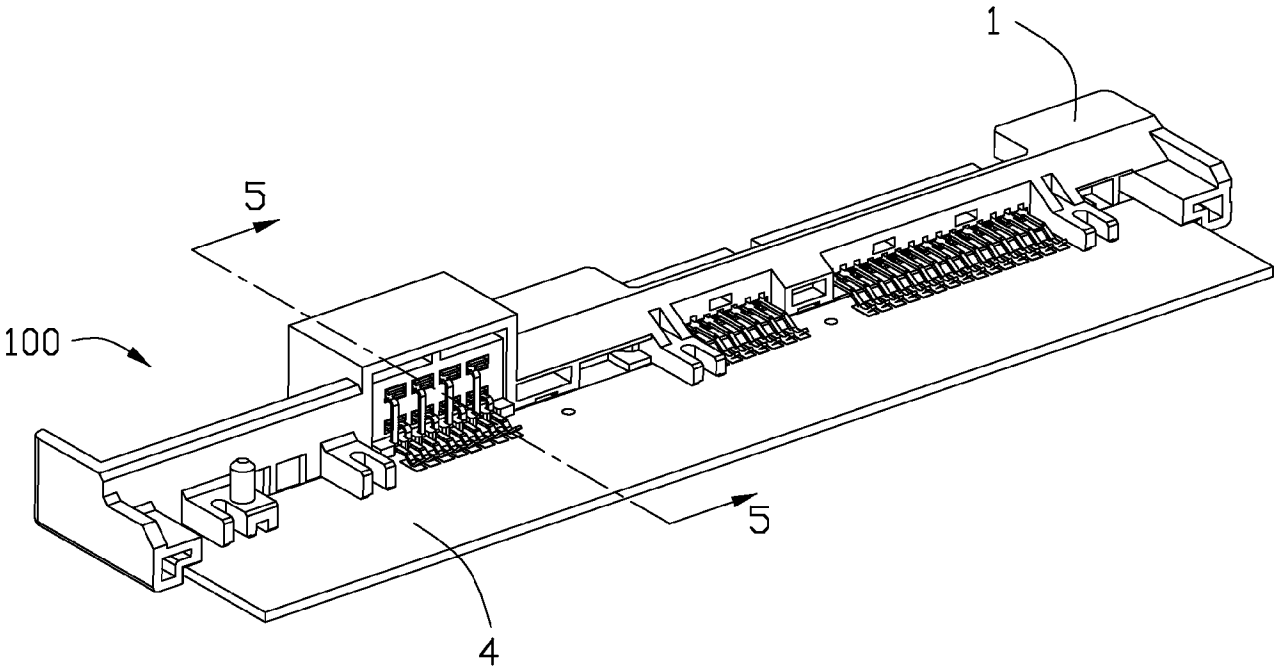
FIG. 1 is an assembled, perspective view of an electrical connector with a printed circuit board assembled therewith according to the present invention.

Reference will now be made in detail to the preferred embodiment of the present invention.

Referring to FIGS. 1-5, an electrical connector 100 according to the present invention is adapted for electrically connecting a complementary connector (not shown) and a print circuit board 4. The electrical connector comprises an insulative housing 1, a plurality of contacts 2 received in the insulative housing 1 and a plurality of positioning pieces 3.

The insulative housing 1 extends along a longitude direction and comprises a longitudinal base 10 and a pair of guiding portions 18 protruding from a front face 11 on two opposite ends of the base. A plurality of positioning blocks 16 protrude from the front face 11 and are defined between the two guiding portions 18. At least a post 160 is defined upwardly on a corresponding positioning block 16. The positioning blocks 16 and the guiding portions 18 are all for retaining the printed circuit board 4 therewith. A first receiving space 14 i.e. mating port and a second receiving space 15 arranged side-by-side are defined in a rear face 12 opposite to the front face 11. The second receiving space 15 has a pair of L-shaped tongue boards 150 extending from an inner face of the second receiving space 15. The first and the second receiving space 14, 15 have a plurality of passageways 13 which extend along a front-to-back direction perpendicular to the longitudinal direction to run through the front face 11 and receive the contacts 2, referring to FIG. 5.

Figure 2:
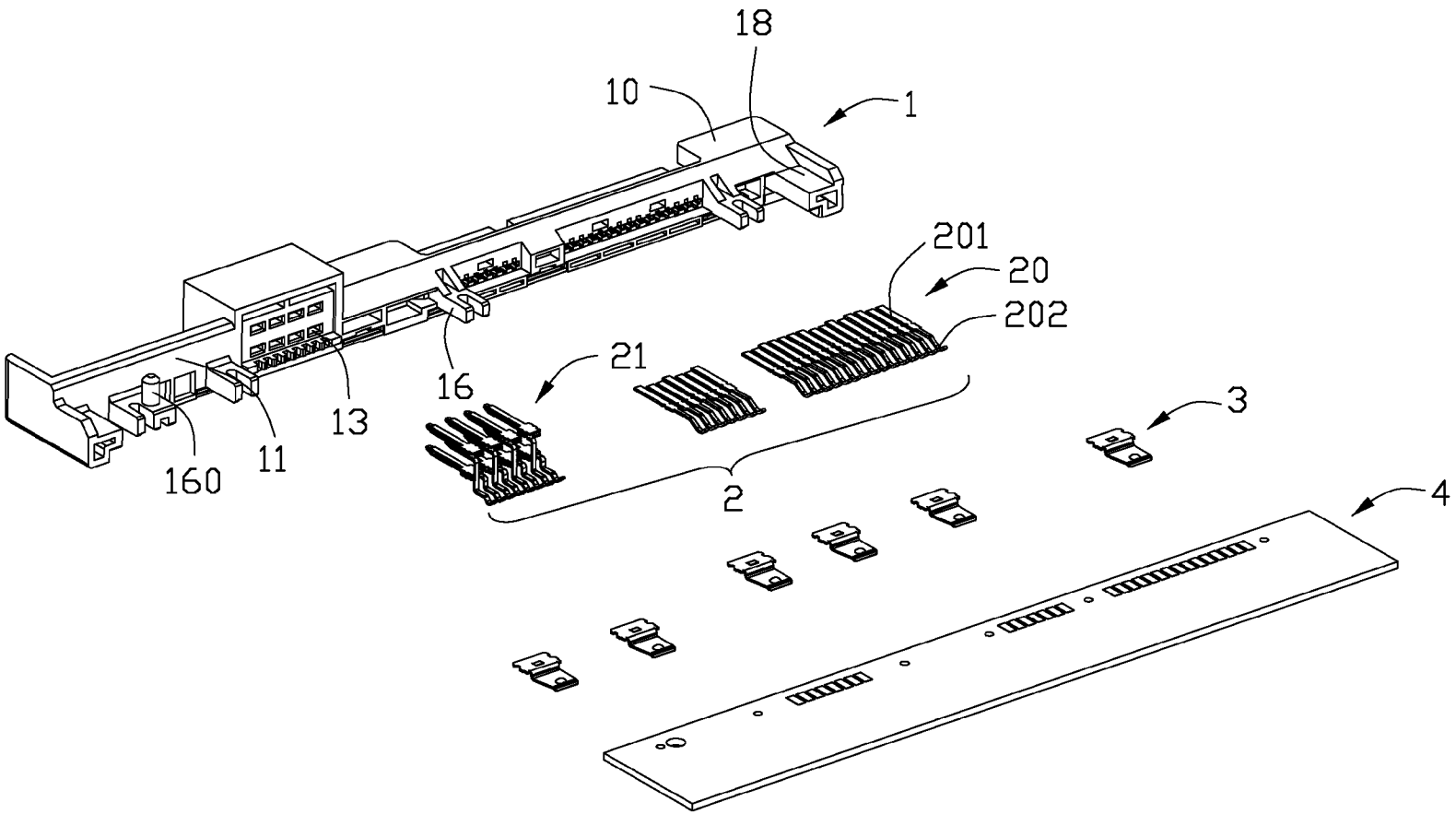
FIG. 2 is an exploded, perspective view of an electrical connector shown in FIG. 1.
Figure 3:
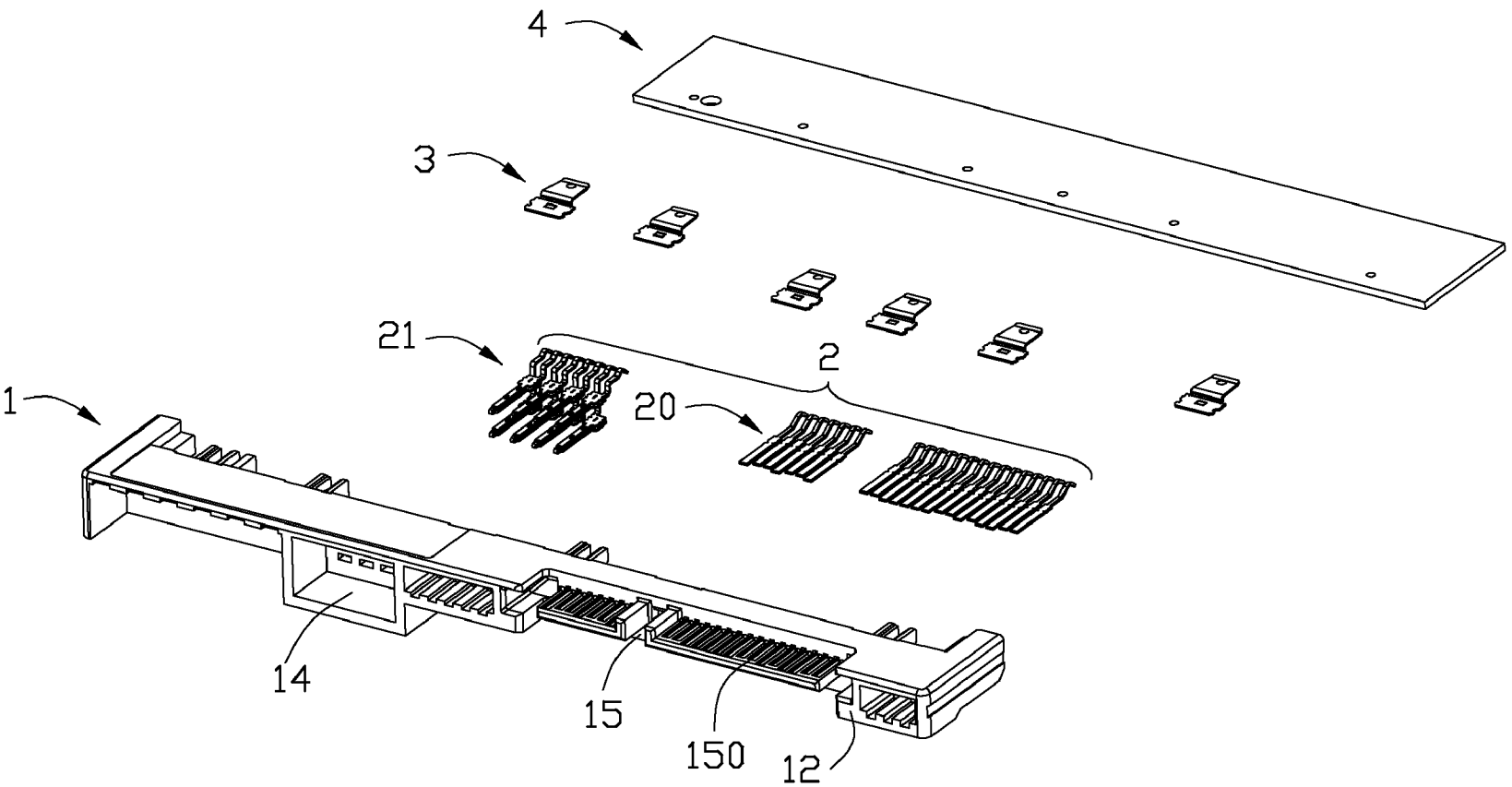
FIG. 3 is an exploded, perspective view of the electrical connector shown in FIG. 1 from another view.
Figure 4:
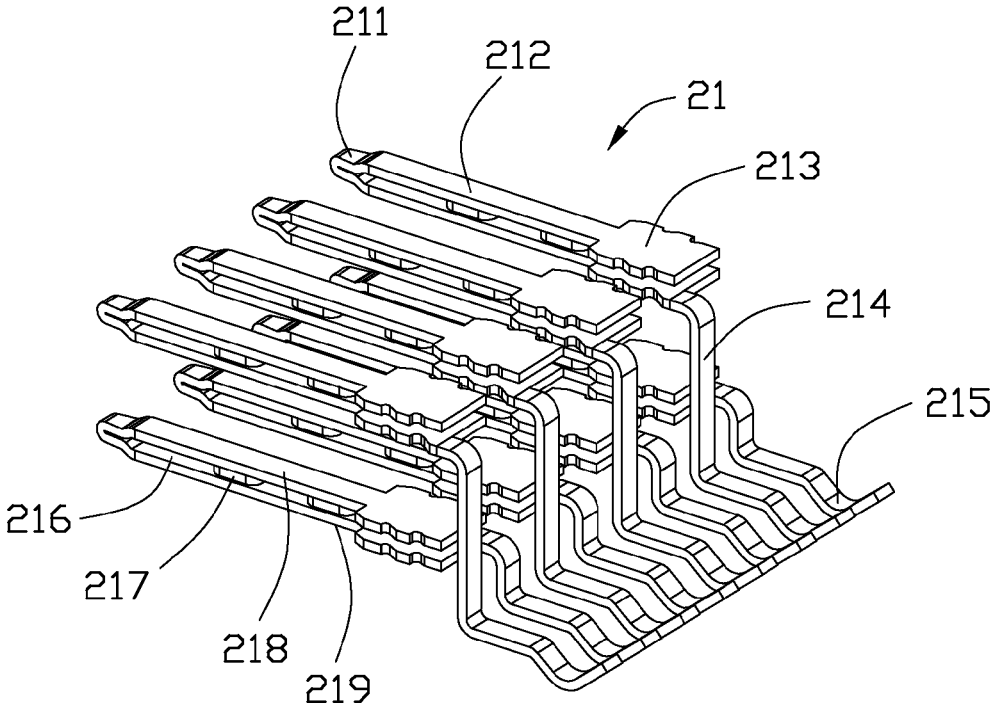
FIG. 4 is a perspective view of the contacts of the electrical connector shown in FIG. 1.
Figure 5:
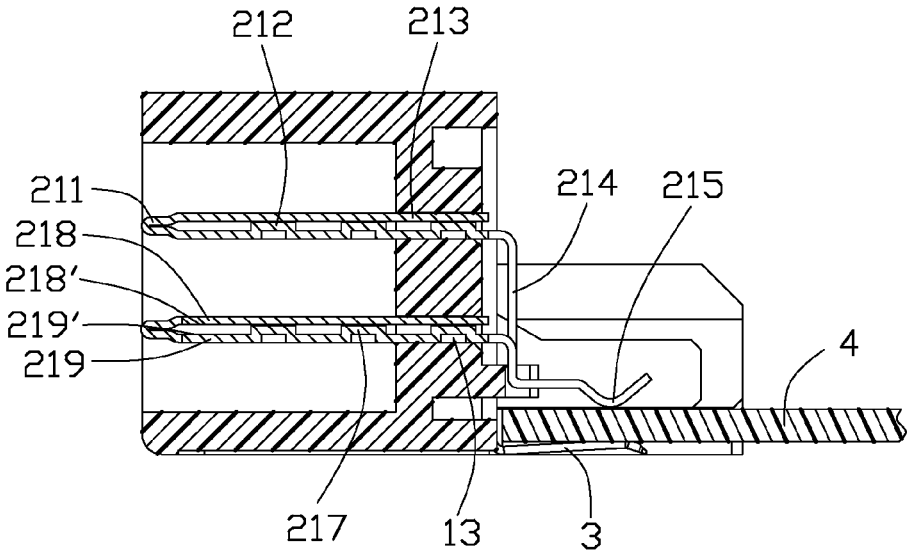
FIG. 5 is a crossing section view of the electrical connector taken along line 5-5 of FIG. 1.

Please refer to FIG. 2, the contacts 2 are divided into two groups, one group is signal contacts 20 and the other group is jumper contacts 21. Each signal contact 20 includes a mating portion 201 embedded in the corresponding passageway 13 and an elastic pressing portion 202 extending from the mating portion 201. Please refer to FIG. 4, the jumper contacts 21 are arranged into upper and lower rows. Each jumper contact 21 defines an upper and lower retaining portion 213 which are parallel to each other. Referring to FIGS. 4 and 5, a mating structure folded in half bridges two retaining portion 213 and comprises a pair of mating arms 212 and a mating end 211. The mating structure defines a pair of inner faces 218', 219' facing to each other and a pair of outer faces 218, 219 facing away from each other. The mating arm 212 extends from an edge of the upper and lower retaining portions 213 respectively. The retaining portion 213 is wider than the mating arm 212 in the longitude direction of the insulative housing 1. The U-shaped mating end 211 is defined to join with the free ends of the mating arms 212 and narrower than the mating arm 212 in the longitude direction of the insulative housing 1. A bending arm 214 extends from the edge of the lower retaining portion 213 which is opposite to the lower mating arm 212 and leads to the printed circuit board 4 vertically. The mating arm 212 and the retaining portion 213 are in a horizontal level, i.e. forming a horizontal portion. The bending arm 214 has a contact portion 215 pressing against the printed circuit board 4 after assembly. The contact portions 215 of the upper and lower jumper contacts 21 are arranged side-by-side and overlapped seen from a direction along which the contacts are arranged. An inter space 216 is defined between the upper and lower retaining portions 213 and mating arms 212 of each jumper contact 21. Three protruding portions 217 protrude from one inner face 219' of the lower mating arm 212 and the lower retaining portion 213 in order to support the other inner face 218' of the upper mating arm 212 and the upper retaining portion 213 in a free state respectively. The width of the mating arm 212 and the distance between two outer faces 218, 219 of each jumper contact 21 are 0.64 millimeters which is widely accepted in the industry in order to mate with a complementary connector (not shown). Each passageway 13 defines a first dimension in a transverse direction perpendicular to both the longitudinal direction and the front-to-back direction. A thickness of each mating arm 212 defines a second dimension. The first dimension is larger than two times of the second dimension so as to form the inter space 216 between two mating arms 212 for providing resiliency thereof in transverse direction.

The positioning piece 3 is partly received in the insulative housing 1 and supports the printed circuit board 4.

As best shown in FIG. 5, the retaining portion 213 is embedded in the passageway 13 after assembly. The protruding portion 217 in the inter space 216 supports the upper mating arm 212 and the upper retaining portion 213. The bending arm 214 and the contact portion 215 are thinner than 0.64 millimeters to provide a better elastic force.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing extending along a longitude direction thereof and having a plurality of passageways arranged along the longitude direction;

a plurality of first contacts received in the passageways;

wherein each of said first contact has an upper and a lower retaining portion which is parallel to each other, a mating arm extends from a rear edge of each retaining portion, a mating end is defined to join the free ends of the mating arms together, a bending arm extends from a front edge of the lower retaining portion, the bending arm has a contact portion pressing against a printed circuit board after assembly, an inter space is defined between the upper and lower retaining portions of each first contact, at least a protruding portion protrudes from the lower mating arm and the lower retaining portion in order to support the upper mating arm and the upper retaining portion respectively.

2. The electrical connector as described in claim 1, wherein the mating end is U-shaped and narrower than the mating arm in the longitude direction of the insulative housing.

3. The electrical connector as claimed in claim 1, wherein the first contacts are arranged in upper and lower rows, the contact portions of the upper and lower first contacts are arranged side-by-side.

4. The electrical connector as claimed in claim 3, wherein the contact portions are overlapped seen from the longitude direction of the insulative housing.

5. The electrical connector as claimed in claim 1, wherein a first receiving space is defined on a rear face and the mating arms of the first contacts received in the first receiving space.

6. The electrical connector as described in claim 1, wherein the electrical connector further includes a plurality of second contacts which are received in a second receiving space adjacent to the first receiving space.

7. The electrical connector as described in claim 6, wherein a pair of L-shaped tongue boards extend outwardly from an inner face of the second receiving space.

8. The electrical connector as claimed in claim 1, wherein a plurality of positioning blocks protrude from a front face of the housing, at least a post is defined upwardly on a positioning block.

9. The electrical connector as claimed in claim 8, wherein the electrical connector further includes a plurality of positioning pieces, each of which is partly received in the insulative housing and supports the printed circuit board.

10. An electrical connector, comprising: an insulative housing defining upper and lower rows of passageways arranged in a longitude direction and each of passageway extending along a front-to-back direction perpendicular to said longitudinal direction;

upper and lower rows of contacts assembled into the corresponding upper and lower rows of passageways, respectively;

wherein each of said contact having a mating structure folded in half, the mating structure defines a pair of inner faces facing to each other and a pair of outer faces facing away from each other, at least one protruding portion protrudes from one of the inner faces to the other inner face.

11. The electrical connector as claimed in claim 10, wherein the protruding portions press against the other inner face in a free state.

12. The electrical connector as claimed in claim 10, wherein the mating portion includes a U-shaped mating end and a pair of parallel mating arms extending from two free ends of the mating end.

13. The electrical connector as claimed in claim 12, wherein a retaining portion defined on a free end of the each mating arm is wider than the mating arm, a bending portion extends from one of the retaining portions of each contact.

14. The electrical connector as claimed in claim 13, wherein a contact portion extends from each bending portion, the contact portions of the contacts are arranged side-by-side and are overlapped seen in a side view.

15. An electrical connector comprising: an insulative housing extending along a longitudinal direction with a mating port in a front face thereof, and defining therein a plurality of passageways each extending along a front-to-back direction perpendicular to said longitudinal direction and defining a first dimension in a transverse direction perpendicular to both said longitudinal direction and said front-to-back direction;

a plurality of contacts disposed in the correspond passageways, respectively, each of said contacts defining a front folded section and a rear bending arm, said folded section including a pair of spaced retaining portions each with thereon retaining devices retained to the corresponding passageway, and a pair of mating arms respectively unitarily extending forwardly from the corresponding retaining portions into said mating port and joined with each other at front ends thereof; wherein a thickness of each of said mating arms defining a second dimension under condition that the first dimension is larger than two times of said second dimension so as to form a gap between said two mating arms in said transverse direction for providing resiliency thereof in said transverse direction; wherein at least one mating arm and the associated retaining portion defines at least one protrusion extending toward and abutting against the other mating arm and the associated retaining portion in said transverse direction so as to fill up said gap thereabouts, thus enhancing a normal force of said folded section in said transverse direction during mating with a complementary connector.

16. The electrical connector as claimed in claim 15, wherein said at least one protrusion is formed on the mating arm.

17. The electrical connector as claimed in claim 15, wherein said at least one protrusion is formed on the associated retaining portion so as to further enhance retention of the corresponding contact within the corresponding passageway.

18. The electrical connector as claimed in claim 16, wherein the mating arm and the associated retaining portion are essentially coplanar with each other.

19. The electrical connector as claimed in claim 16, wherein said bending arm extends from only one of said retaining portions.

20. The electrical connector as claimed in claim 19, wherein said bending arm includes a vertical bend and a horizontal contact portion both of which are exposed outside of the housing.

* * * * *